US012330015B2

(12) United States Patent
Duessel

(10) Patent No.: US 12,330,015 B2
(45) Date of Patent: Jun. 17, 2025

(54) DEVICE TO BALANCE APPLICATION OF FORCE

(71) Applicant: Christian Duessel, Dallas, TX (US)

(72) Inventor: Christian Duessel, Dallas, TX (US)

( * ) Notice: Subject to any disclaimer, the term of this patent is extended or adjusted under 35 U.S.C. 154(b) by 309 days.

(21) Appl. No.: 17/382,802

(22) Filed: Jul. 22, 2021

(65) Prior Publication Data

US 2023/0028425 A1 Jan. 26, 2023

(51) Int. Cl.

| | |
|---|---|
| ***A63B 21/00*** | (2006.01) |
| ***A63B 1/00*** | (2006.01) |
| ***A63B 22/00*** | (2006.01) |
| ***A63B 23/12*** | (2006.01) |

(52) U.S. Cl.

CPC ..... *A63B 21/4047* (2015.10); *A63B 1/00* (2013.01); *A63B 21/4034* (2015.10); *A63B 21/4035* (2015.10); *A63B 22/0076* (2013.01); *A63B 23/1218* (2013.01)

(58) Field of Classification Search

CPC ... A63B 21/4047; A63B 1/00; A63B 21/4034; A63B 21/4035; A63B 22/0076–0089; A63B 21/00185; A63B 21/008–0083; A63B 21/0085–0087; A63B 21/02; A63B 21/023; A63B 21/15; A63B 21/159; A63B 21/16; A63B 21/28; A63B 21/285; A63B 22/0058; A63B 2022/0092; A63B 2024/0012; A63B 2071/0652; A63B 2220/51; A63B 22/14–18; A63B 22/20–203; A63B 23/03516; A63B 23/04; A63B 2220/50–52; A63B 22/16; A63B 26/003–2026/006

USPC ..... 482/133–138

See application file for complete search history.

(56) References Cited

U.S. PATENT DOCUMENTS

| | | | | |
|---|---|---|---|---|
| 5,807,210 | A * | 9/1998 | Devlin | A63B 22/0056 482/52 |
| 7,901,332 | B1 * | 3/2011 | Wen | A63B 22/205 482/52 |
| 10,946,247 | B1 * | 3/2021 | Burton | A63B 71/0054 |
| 2003/0186794 | A1 * | 10/2003 | Vittone | A63B 21/4029 482/142 |
| 2006/0014612 | A1 * | 1/2006 | Yang | A63B 22/0056 482/53 |
| 2018/0236300 | A1 * | 8/2018 | Yao | A63B 22/0058 |

FOREIGN PATENT DOCUMENTS

| | | | | |
|---|---|---|---|---|
| KR | 10-2009-0037294 | * | 4/2009 | A63B 21/4047 |

OTHER PUBLICATIONS

Translation of KR 10-2009-0037294 (Year: 2009).*

* cited by examiner

*Primary Examiner* — Loan B Jimenez
*Assistant Examiner* — Catrina A Letterman
(74) *Attorney, Agent, or Firm* — HSML P.C.

(57) ABSTRACT

A training device may include a left-side actuator to receive a user's left-sided force at a proximate end thereof; a right-side actuator to receive a user's right-sided force at a proximate end thereof; and a fulcrum that may be attached equidistant to a distal end of the left-side actuator and a distal end of the right-side actuator, to facilitate equal application of force from the user on the left actuator and the right actuator.

10 Claims, 13 Drawing Sheets

DEVICE TO BALANCE APPLICATION OF FORCE

TECHNICAL FIELD

The embodiments described herein pertain generally to athletic, sport, and physical therapy training devices.

BACKGROUND

Compound exercise motions are effective to strengthen several muscle groups at a time, however, users can develop right or left side imbalances. Some sport or athletic endeavors require balanced strength for success. For example, in rowing sports in which a single rower or teams of rowers work together to race their respective shells, an imbalance of power between a right side and a left side of a rower(s) may be a competitive disadvantage. In sport and athletic endeavors, asymmetrical exertion of force may also result in injury. Further, physical therapy to recover from injury on one side may need to correct an imbalance of power.

SUMMARY

In one example embodiment, a training device may include a left actuator to receive a user's left-sided force at a proximate end thereof; a right actuator to receive a user's right-sided force at a proximate end thereof; and a fulcrum that may be attached equidistant to a distal end of the left actuator and a distal end of the right actuator, to facilitate equal application of force from the user on the left actuator and the right actuator.

In another example embodiment, a training device may include a main frame that may be detachably mounted on to training equipment; a fulcrum that may be attached to a backside of the main frame; a main lever that may be centrally and axially connected to the fulcrum; a laterally-disposed left-side actuator that may have a proximate end to which a user applies force and a distal end attached to a left end of the main lever; and a laterally-disposed right-side actuator that may have a proximate end to which the user applies force and a distal end attached to a right end of the main lever, to facilitate equal application of force from the user on the left actuator and the right actuator.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1A:
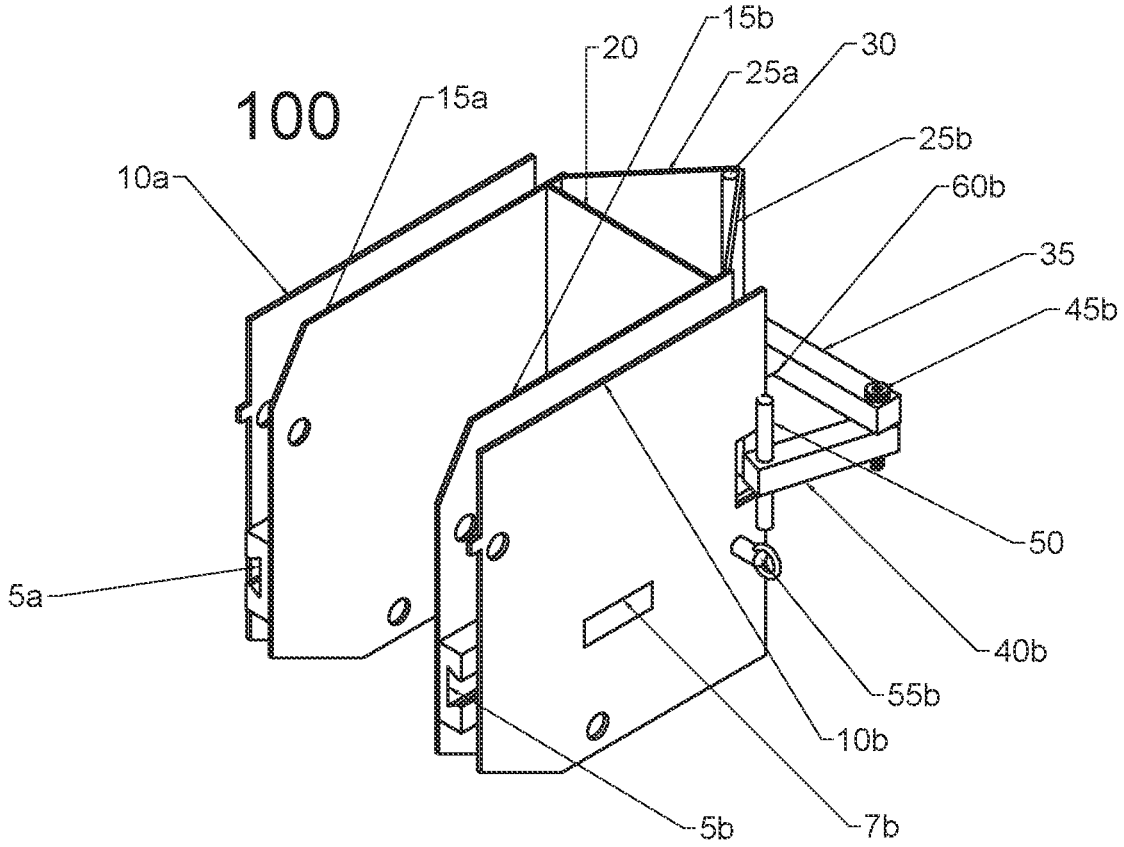
FIG. 1*a* is a perspective view of the device balancing application of force, according to example embodiments described and recited herein.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current example embodiment. Still, the example embodiments described in the detailed description, drawings, and claims are not intended to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

The devices, or alternatively apparatuses, described and recited herein are designed, configured, and implemented to train or otherwise promote or force an equal distribution of left-side and right-side force by a user. The force distributed by the user may be applied in a pushing or pulling manner, depending upon how the device is being utilized. In accordance with a non-limiting example, the device may be mounted on or otherwise attached to a stationary rowing machine, thus the device may be utilized to promote an equal distribution of force distributed by the user pushing with his or her left and right legs, back, and arms, respectively. In accordance with at least one other non-limiting example, the device may be integrated with or otherwise connected to a pull-up bar, thus the device may be utilized to promote an equal distribution of force exerted as the user pulls with his or her left and right arms, respectively. The utilization and/or implementation of the device, as described and recited herein is not limited to such examples.

As referenced herein, the force may be exerted in either of a pushing or pulling manner, depending on an implementation of the device. Further still, units of measurement for the power or exerted force are not needed for the description or recitation, since the device recited and described herein is designed, configured, and implemented to train or otherwise promote or force an equal distribution of force by a left arm, hand, leg, and/or foot of a user relative to a right arm, hand, leg, and/or foot of the user.

In the present training device, if the user applies asymmetrical force, the user receives feedback and can adjust the force applied to strengthen the side that applied less force. With continued use, the user can learn to apply force in a more efficient, more symmetrical manner.

The embodiments of the device to balance application of force described and recited herein may be utilized as part of or as an adjunct to compound exercise equipment to improve such equipment with the capability to train for symmetrical strength, musculature, and force application. Of course, the embodiments described and recited herein are not limited to the promoting balance of force applied or exerted by a user's left side relative to force applied or exerted by the user's right side. That is, alternative embodiments may be implemented to promote a balance or equal exertion of force by one or more users on a left side of the device relative to an exertion of force by one or more users on a right side of the device.

As an example, the device may be permanently or removably attached between existing force inputs, e.g., left and right foot pedals, for compound exercise equipment, e.g., a rowing machine. Force applied by a user to the left foot pedal may be applied to a left-side actuator, and force applied by the user to the right foot pedal may be applied to a right-side actuator.

As referenced herein, the left and right force inputs may be affixed permanently or removably to an end of the respective actuators that is proximate to the user. Therefore, the proximate end of the respective actuators receives the force applied by the user. Accordingly, the distal end of the respective actuators may be attached to a common point, e.g., a fulcrum or lever, or may bias a common piece of the device that in turn may be attached to the common point.

As a result of the force applied by the user to both the left- and the right-side actuators influencing hinging of a portion of the device at the common point, e.g., fulcrum or lever, the actuator on the side to which the greater amount of force is applied may extend further than the actuator on the other side.

Therefore, with regard to the example implementation of the device in connection with a rowing machine, when force applied by a combination of the user's right leg, back, and arm on the right-side foot pedal and actuator exceeds the force applied by a combination of the user's left leg, back, and arm on the left-side foot pedal and actuator, then the right-side foot pedal and actuator extend further in a distal direction away from the user, and the left-side foot pedal and actuator extend further in a proximate direction towards the user. The opposite is realized if the force applied by a combination of the user's left leg, back, and arm on the left-side foot pedal and actuator exceeds the force applied by a combination of the user's right leg, back, and arm on the right-side foot pedal and actuator. Accordingly, the user may be prompted to balance the application of force onto the respective foot pedals and actuators.

With regard to the example implementation of the device in connection with a pull-up bar, when force applied by a combination of the user's right arm and hand on the right-side pull-up handle and actuator exceeds the force applied by a combination of the user's left arm and hand on the left-side pull-up handle, then the right-side pull-up handle and actuator extend further in a proximate direction towards the user, and the left-side pull-up handle and actuator extend further in a distal direction away from the user. Similarly, the opposite is realized when force applied by a combination of the user's left arm and hand on the left-side pull-up handle and actuator exceeds the force applied by a combination of the user's right arm and hand on the right-side pull-up handle. Accordingly, the user may be prompted to balance the application of force onto the respective sides of the pull-up handle and actuators.

In accordance with example implementations of the device to balance application of force, as described and recited herein, asymmetrical force applied to an actuator may be countered by reducing force applied to that actuator and/or increasing force applied to the other actuator. Thus, the device may be utilized to train equal application of force.

Figure 1B:
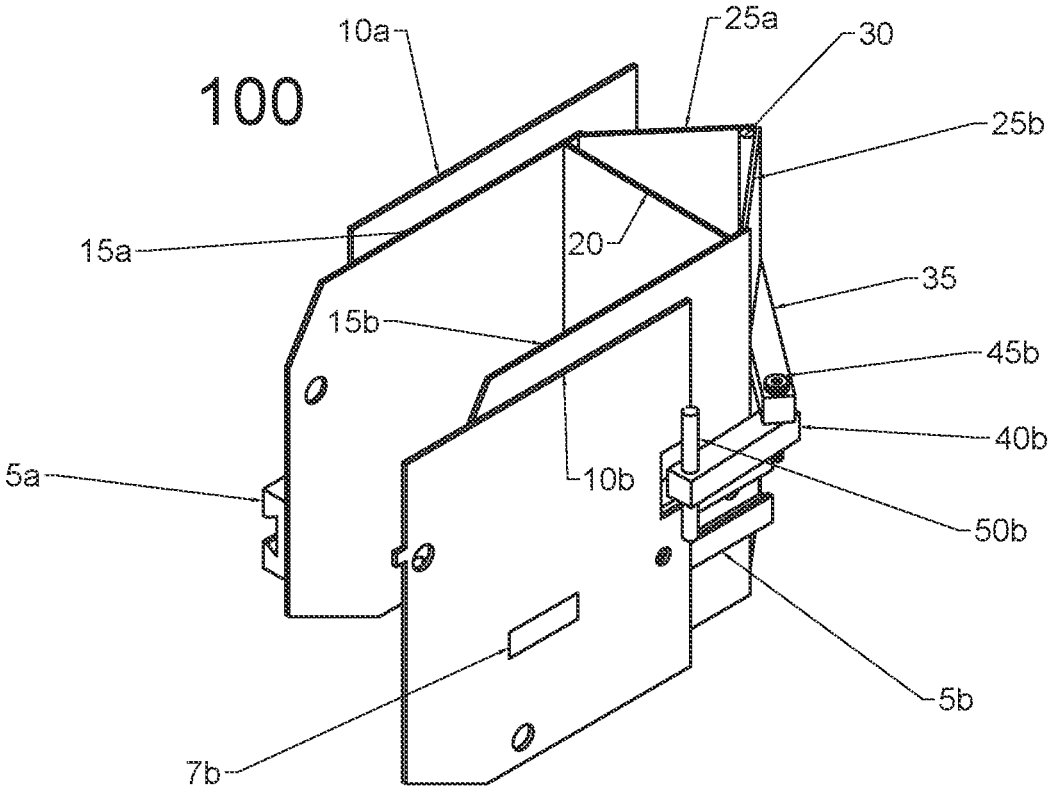
FIG. 1*b* is a perspective view of the device to balance unequal application of force, according to example embodiments described and recited herein.
Figure 2A:
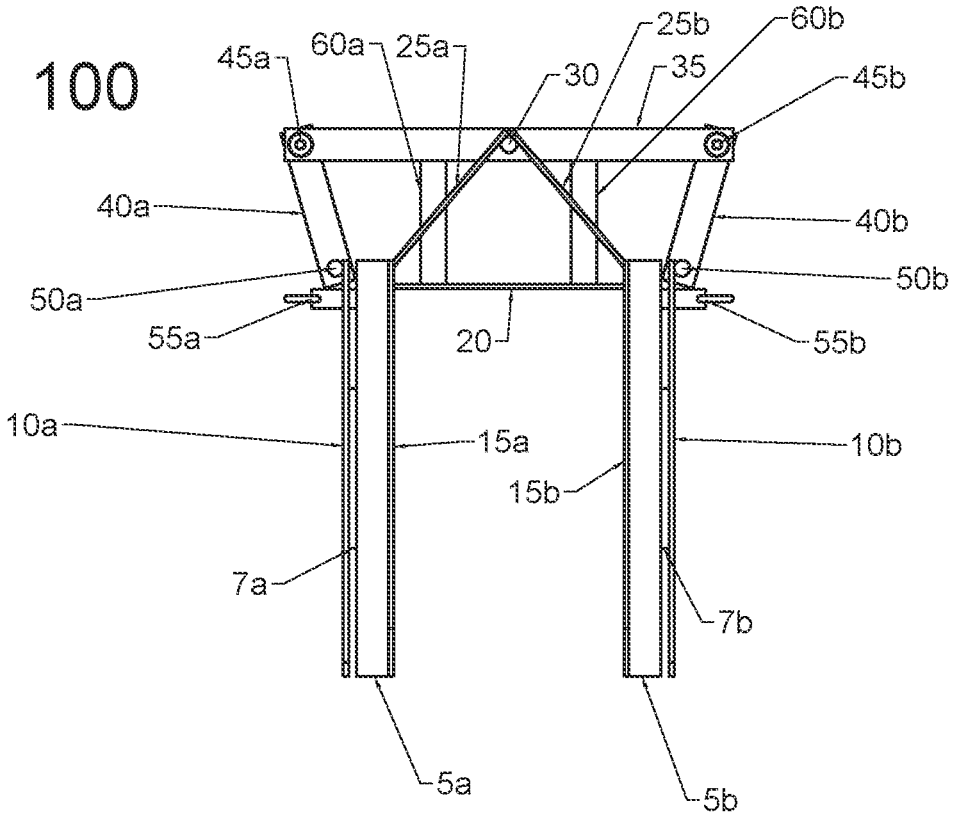
FIG. 2*a* is a top view of the device balancing application of force, according to example embodiments described and recited herein.
Figure 2B:
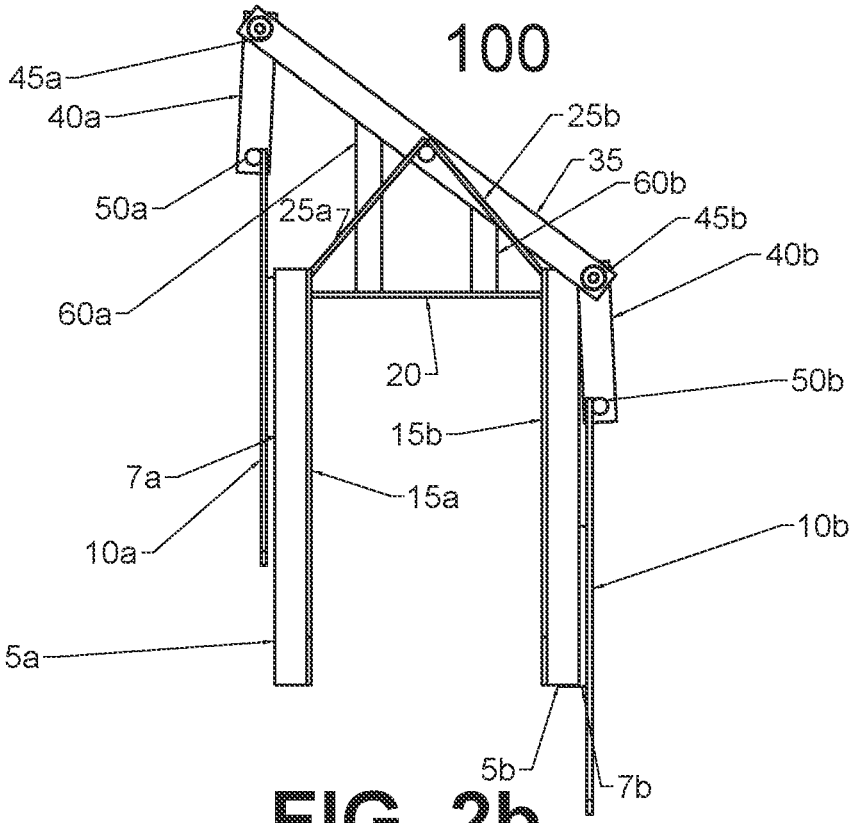
FIG. 2*b* is a top view of the device to balance unequal application of force, according to example embodiments described and recited herein.
Figure 3:
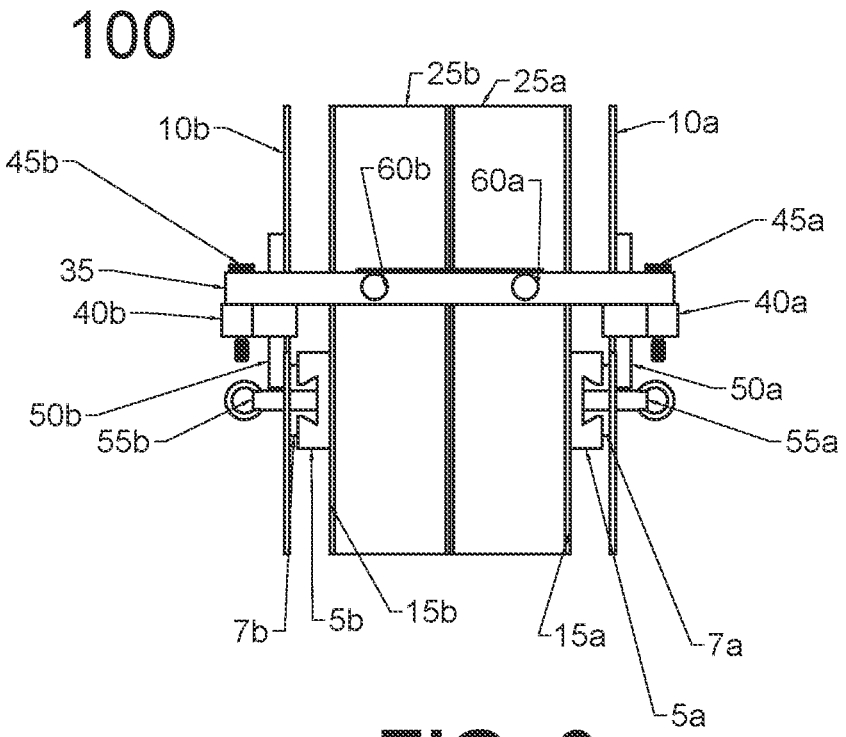
FIG. 3 is a rear view of the device to balance application of force, according to example embodiments described and recited herein.
Figure 4:
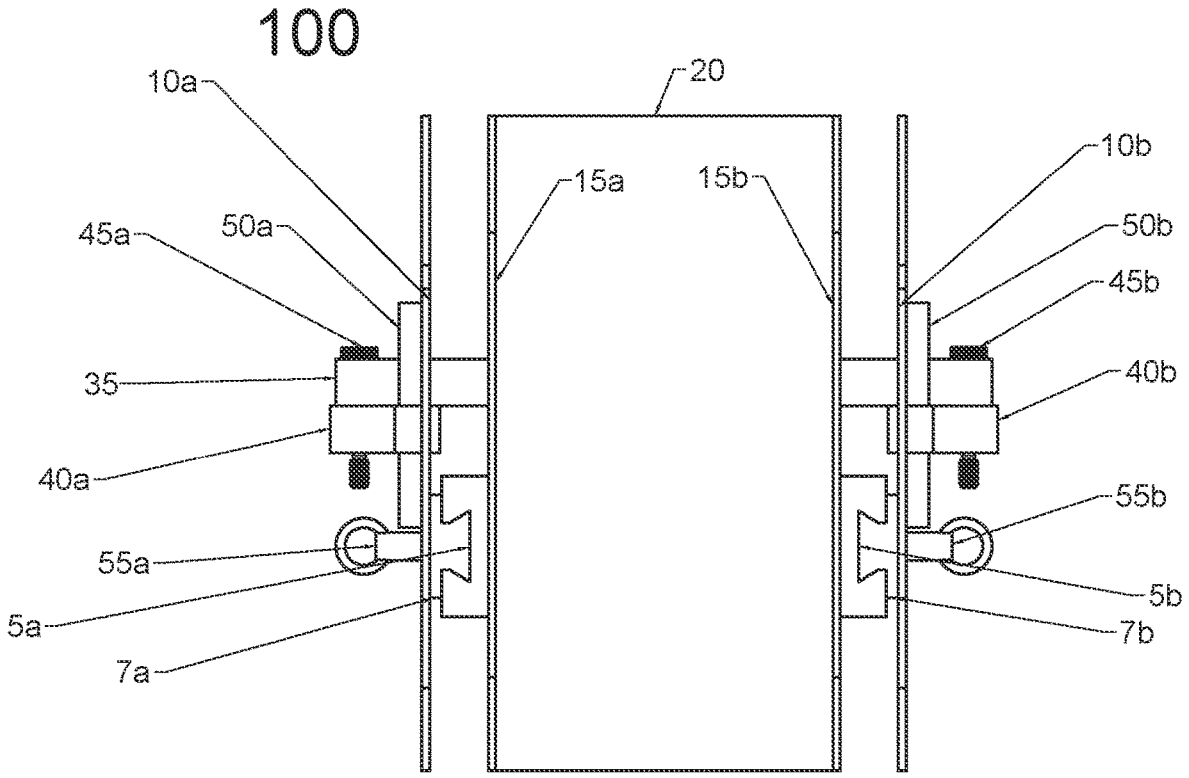
FIG. 4 is a front view of the device to balance application of force, according to example embodiments described and recited herein.

FIG. 1*a* is a perspective view of the device balancing application of force, and FIG. 1*b* is a perspective view of the device to balance unequal application of force, according to example embodiments described and recited herein; FIG. 2*a* is a top view of the device balancing application of force, and FIG. 2*b* is a top view of the device to balance unequal application of force, according to example embodiments described and recited herein; FIG. 3 is a rear view of the device to balance application of force, according to example embodiments described and recited herein; and FIG. 4 is a front view of the view of the device to balance application of force, according to example embodiments described and recited herein. FIGS. 1*a*, 2*a*, 3 and 4 show device 100 in a neutral position, i.e., in a position at which the application of force by a user is equal between the left side and right side. FIGS. 1*b* and 2*b* show device 100 in an offset position, i.e., in a position at which the application of force by a user is not equal between the left side and right side.

As depicted in FIGS. 1-4, device 100 includes at least rails 5*a* and 5*b*, buffers or rollers 7*a* and 7*b*, outer side plates 10*a* and 10*b*, inner side plates 15*a* and 15*b*, back-plate 20, lever-framing plates 25*a* and 25*b*, fulcrum 30, main lever 35, lever arms 40*a* and 40*b*, lever pivot points 45*a* and 45*b*, lever arm pivot points 50*a* and 50*b*, retaining pins 55*a* and 55*b*, which may be removable, and damping arms 60*a* and 60*b*.

With regard to the components shown in FIGS. 1*a* and 1*b* listed above, since device 100 is implemented to promote or force an equal distribution of force, vis-à-vis left and right side, it follows that device 100 itself includes a plurality of components that have left- and right-side components. Hence, for descriptive purposes only, a component having a reference number followed by "a" may be understood as pertaining to a left-side component, and component having a reference number followed by "b" may be understood as pertaining to a right-side component. However, again for descriptive purposes only, unless context otherwise requires, the components may, in the alternative, be described either singularly or in the plural with regard to just the reference number without the "a" or "b." Further, it is to be understood that all of the left-side and right-side components "a" and "b" are symmetrical in size and positioning, unless otherwise indicated.

Rails 5*a* and 5*b* may, respectively, refer to a dovetail slide rail having a female or grooved receptor that extends longitudinally, i.e., from the proximate end to the distal end, of the device. Accordingly, rails 5*a* and 5*b* may also be referred to as "female" rails. Rails 5 may be made of steel, bronze, other metals, plastic, or composite material.

Rails 7*a* and 7*b* may, respectively, refer to a dovetail slide having male geometry that extends part or the entire way from the proximate end to the distal end of the device. Accordingly, rails 7*a* and 7*b* may also be referred to as "male" rails. Rails 7 may be made of steel, bronze, other metals, plastic, or composite material.

Plates 10 and 15 may refer to plates made of steel, bronze, other metals, plastic, or composite material that provide structural integrity for device 100. In accordance with the embodiments described and recited herein, plates 10 and 15 have substantially similar dimensions and broad faces of plates 10 and 15 are parallel to each other. At a proximate end of device 100, to which portions of separate exercise equipment may be attached, plates 10 and 15 may be equally aligned length-wise, i.e., longitudinally, when in a neutral position, so as to be evenly joined with the exercise equipment.

Plate 20 may refer to another plate made of steel, bronze, other metals, plastic, or composite material that provides structural integrity for device 100. In accordance with the embodiments described and recited herein, plate 20 may be disposed orthogonally to plates 10 and 15. Plates 10, 15, and 20 may be aligned to be of equal or substantially similar height. Further, lateral ends of plate 20 may be welded or otherwise adhered to distal lateral ends of plate 15, such that plates 15*a* and 15*b* are parallel to each other and orthogonal to plate 20.

Plate 15 may be configured to have a back portion of rail 5 welded to or otherwise adhered to a broad surface of plate 15 that faces a broad surface of plate 10.

Plate 10 may be configured to have the rail 7 welded to or otherwise adhered to a broad surface of plate 10 that faces rail 5, which is welded to or otherwise adhered to broad surface of plate 15.

Further, the rail system, composed of male component (e.g., male rail 7) and female component (e.g., female rail 5) may be disposed between plates 10 and 15. The male rail 7 may be designed or configured to slide into the female rail 5. The rail system comprised of 7 and 5 may be constructed to be a dovetail rail system, or may be some other kind of rail system that maintains the parallelism of plates 10*a* and 10*b* as they move in the proximate or distal direction from the user. Accordingly, as the male rail 7 slides in the female rail 5, plate 10 may slide longitudinally, i.e., from a proximate end of device 100 to a distal end thereof, and vice-versa.

Plate 15 may be further configured to mount or otherwise attach device 100 to the separate piece of exercise equipment, e.g., rowing machine or pull-up bar. In accordance with such embodiments, the exercise equipment may have an arm or extension to align with the holes in plate 15*a* and another arm or extension to align with the holes in plate 15*b*; alternatively, the exercise equipment may have a single arm or extension on which a left side has one or more holes to align with the holes in plate 15*a* and on which a right side has one or more holes to align with the holes in plate 15*b*.

In accordance with such embodiments, the exercise equipment may have an arm or extension to align with the holes in plate 15*a* and another arm or extension to align with the holes in plate 15*b*; alternatively, the exercise equipment may have a single arm or extension on which a left side has one or more holes to align with the holes in plate 15*a* and on which a right side has one or more holes to align with the holes in plate 15*b*.

However, such embodiments are examples only and not intended to be limiting to the scope of the device as described and recited herein. Alternative embodiments may include plate 15 having notches or receptors along a bottom portion so as to fit atop an arm or extension corresponding to the exercise equipment. As an addendum to such non-limiting example embodiments, plate 15 may again have identically aligned holes to receive pin 55, to secure device 100 to the exercise equipment, that may also be inserted to a corresponding hole in the arm or extension of the exercise equipment.

In accordance with at least one example embodiment of device 100, as shown in FIGS. 1-4, pins 55*a* and 55*b* may be inserted into a hole in plates 10 as well as in a corresponding hole in rails 7. Thus, the potential for movement of the plates 10 may be eliminated and the functionality of the device may be temporarily suspended at the user's discretion. In this way, the user could use the exercise equipment as if the device was not attached, without having to remove the whole apparatus.

In accordance with at least one non-limiting embodiment of device 100 described and recited herein, plate 10 may be further configured to have an opening carved at a distal end thereof. At either a top portion or a bottom portion of the opening, a horizontally-planed extension may protrude from plate 15, and the horizontally-planed extension may have a horizontally-configured hole that aligns with a horizontally-configured hole in lever-pivot bar 40, so as to receive pin or hinge at lever arm pivot points 50, so that pivot bar 40 may pivot or swivel horizontally, relative to orthogonally aligned plate 15.

Pin/hinge at the lever arm pivot points 50 may refer to a metal, plastic, or composite material rod or shoulder bolt that may be welded or otherwise adhered to an end of plates 10.

Lever-pivot bars 40*a* and 40*b* may be attached, at a proximate end thereof, to plate 10, so as to pivot or swivel as the respective actuators extend laterally between the respective proximate end and the distal end.

Lever 35 may refer to a bar made of steel, bronze, other metals, plastic, or composite material.

Fulcrum 30 may be centrally disposed on lever 35, serving as a pivot point about which lever 35 may pivot or swivel. Fulcrum 30 may be a steel, bronze, other metals, plastic, or composite material-based rod or peg that may be centrally welded or otherwise adhered to lever 35.

Lever-pivot bars 40*a* and 40*b* may be attached, at a distal end thereof, to respective ends of lever 35, which may also pivot or swivel horizontally in a planar manner, under the influence of lever-pivot bars 40, as the actuators extend laterally between the respective proximate end and distal end. The points of connection (e.g., lever points 45*a* and 45*b*) between lever pivot bars 40*a* and 40*b* and lever 35 may be implemented by a hinge or pin that is vertically inserted into corresponding holes at the distal points of lever-pivot bars 40*a* and 40*b* and the respective ends of lever 35. Pin/hinge at points of connection (e.g., at the lever point 45) may refer to a metal, plastic, or composite material rod or shoulder bolt that may be welded or otherwise adhered to respective ends of lever 35.

Plates 25 may refer to sheets of steel, bronze, other metals, plastic, or composite material, each of which has one lateral end that is symmetrically welded or otherwise adhered to a lateral end region of plate 20. The other lateral end of plates 25 may converge to be welded or otherwise adhered at fulcrum 30 (e.g., at bearing or bushing of the fulcrum 30). Fulcrum 30 (e.g., bearing of bushing of the fulcrum 30) may serve as a pivot point about which lever 35 rotates or swivels.

Accordingly, as excessive force is applied to an actuator attached to the right side of the device at plate 10*b*, e.g. the right footplate from the rowing machine, and therefore applied to plate 10*b*, the lever-pivot bar biases a right-side of lever 35 to extend further in the distal direction and, correspondingly, a left-side of lever 35 is biased to extend in the proximal direction, thus pushing the actuator that includes a left-side insertion and plate 10*a*.

As a result, as an intended use of device 100, the user may be prompted to apply force equally on both the left- and the right-side of the exercise equipment, either by increasing force applied on the left side or reducing force applied on the right side.

Device 100 may be implemented as an adjunct attachment for a rowing machine footplate. By at least one example implementation, device 100 may have vertically arranged plates 15 that are bolted or otherwise adhered to the rowing machine and provide a frame for device 100.

Plates 15 may be connected to plate 20 and plates 25 to complete the frame for the device. Plates 15 and 25 may be welded or otherwise adhered together or bent from a single piece of sheet metal, plastic, or composite material.

Plate 25 may support the fulcrum 30, which may be welded or otherwise adhered in place.

Lever 35 may be regarded as a main pivot crossmember that stretches the width of device 100. Lever 35 may connect via shoulder bolts (e.g., connection points 45 being shoulder bolts) with a slip fit to lever-pivot bars 40, which connect to pivot rods (e.g., lever arm pivot points 50 being pivot rods) via a slip fit. Rods at lever arm pivot points 50 may be welded or otherwise adhered to plates 10 to which footplates from the rowing machine may connect.

Damping arms 60 may represent springs, pistons or some other adjustable damping mechanism that may be used to resist the motion of the device. These could connect from the support member (e.g., plate 20) to the main lever 35, resisting the pivoting of the main lever 35. This damping of the movement would make it easier for new users to become accustomed to the device. Starting out, new users could employ the damping system and thereby reduce the feedback of the device. As users improve in symmetrical force application, they could reduce the damping system and make the device more sensitive to smaller asymmetries.

Figure 5A:
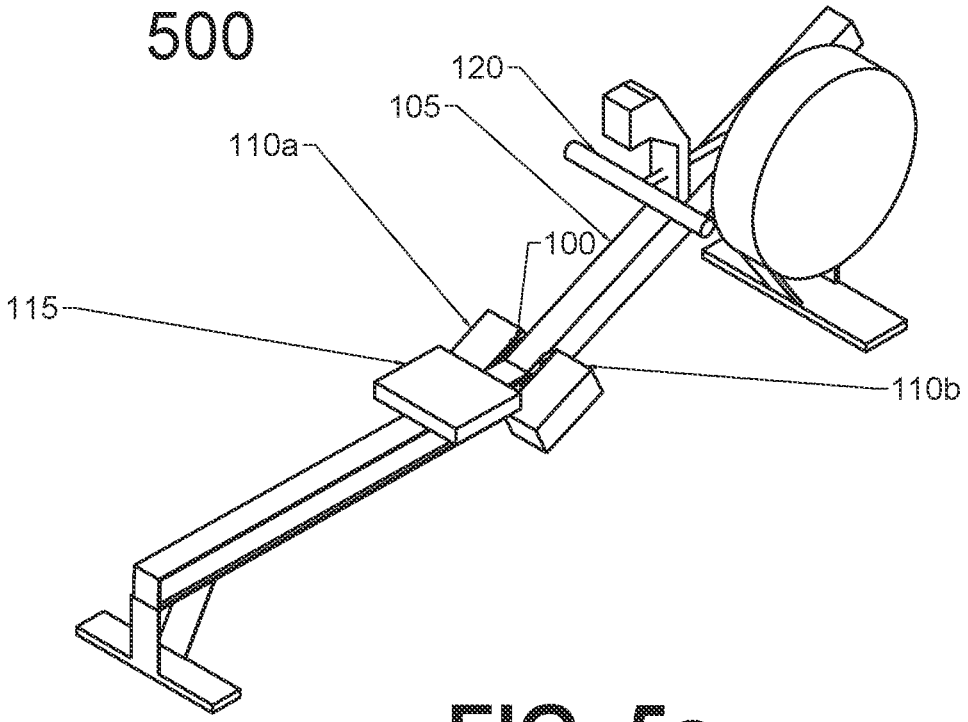
FIG. 5*a* is a perspective view of the device to balance application of force, according to example embodiments described and recited herein, attached to an existing rowing machine.
Figure 5B:
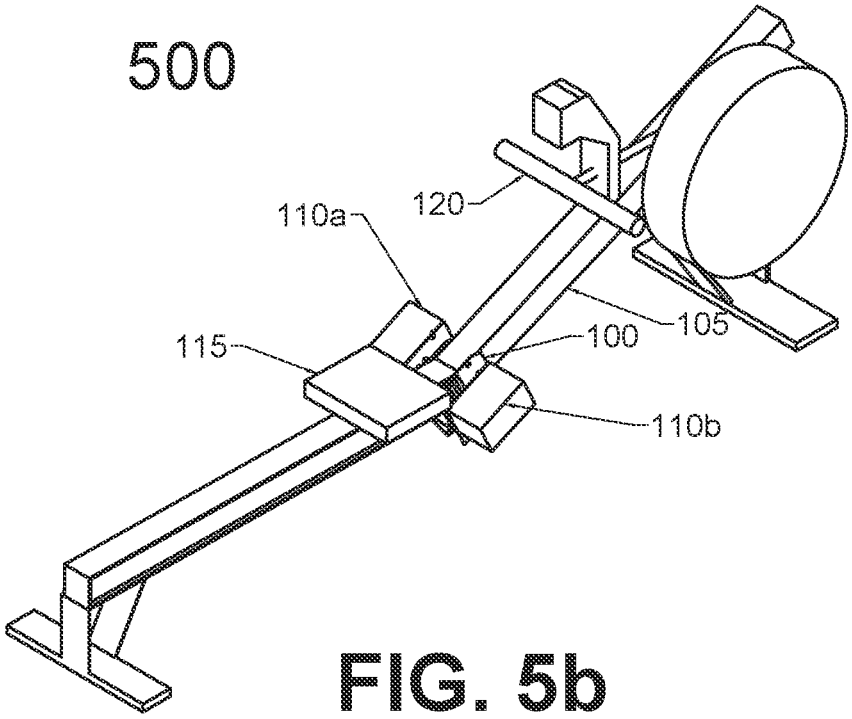
FIG. 5*b* is a perspective view of the device to balance unequal application of force, according to example embodiments described and recited herein, attached to an existing rowing machine
Figure 6:
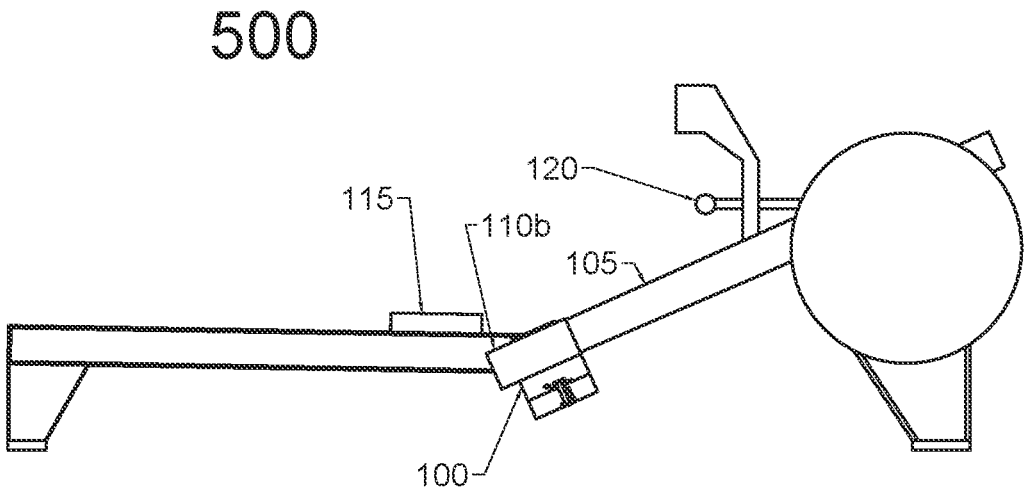
FIG. 6 is a side view of the device to balance application of force, according to example embodiments described and recited herein, attached to an existing rowing machine.

FIG. 5*a* is a perspective view of the device to balance application of force, according to example embodiments described and recited herein, attached to an existing rowing machine, FIG. 5*b* is a perspective view of the device to balance unequal application of force, according to example embodiments described and recited herein, attached to an existing rowing machine, and FIG. 6 is a side view of the device to balance application of force, according to example embodiments described and recited herein, attached to an existing rowing machine;

FIGS. 5*a*, 5*b*, and 6 show the device attached to a rowing machine. Body 105 may refer to the main body of rowing machine 500, to which the device 100 connects. Footplates 110 of rowing machine 500 may connect to body 105. Accordingly, body 105 serves to connect footplates 110 to device 100.

As a user sits on seat 115 and places the user's feet on footplates 110 and grabs handle 120, the user performs a rowing stroke by applying force to the footplates with their legs and swings his or her upper body to finish the rowing motion by pulling handle 120 towards the user's body.

When force applied by the user is not even between the left side and the right side, the footplates adjust accordingly and the user may be prompted to actively compensate for the asymmetrical application of force. For example, if the user is right leg dominant and the user's right pushes harder at the beginning of the stroke, pushing the right footplate away from the user and the left footplate toward the user, the user would then have to actively push harder with his or her left leg to balance the force on the footplate. Over time, the user would train out the asymmetries in their legs, back, core, and arms by means of this active compensation.

Figure 7:
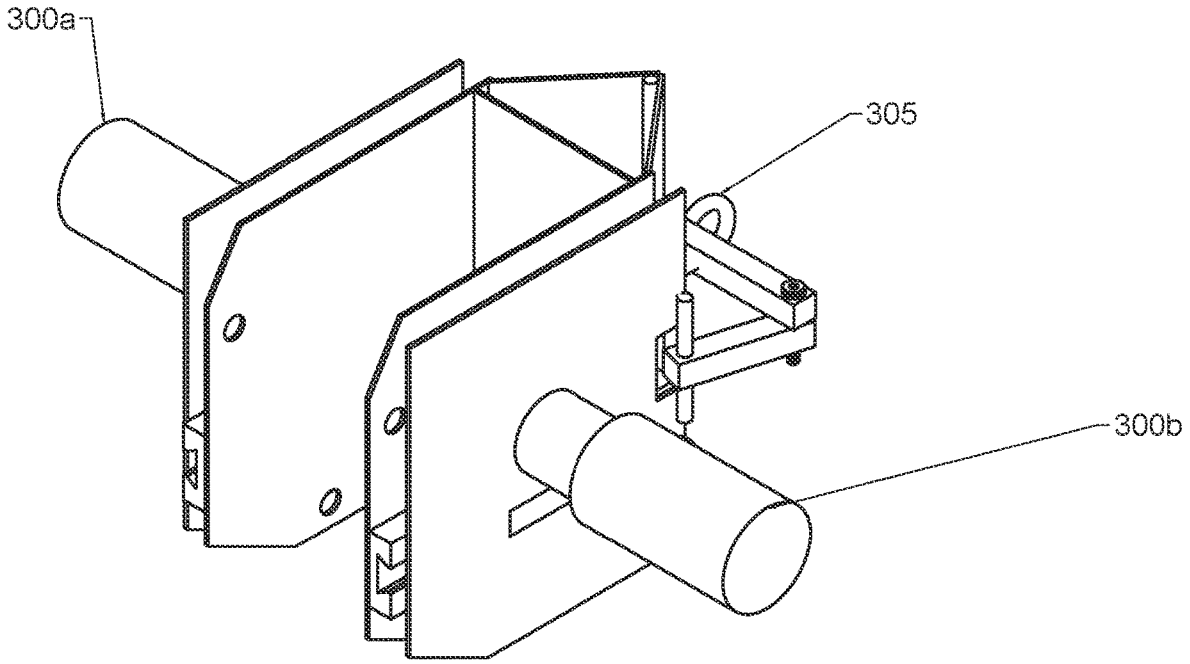
FIG. 7 is a perspective view of an alternative embodiment of the device to balance application of force, according to example embodiments described and recited herein.
Figure 8:
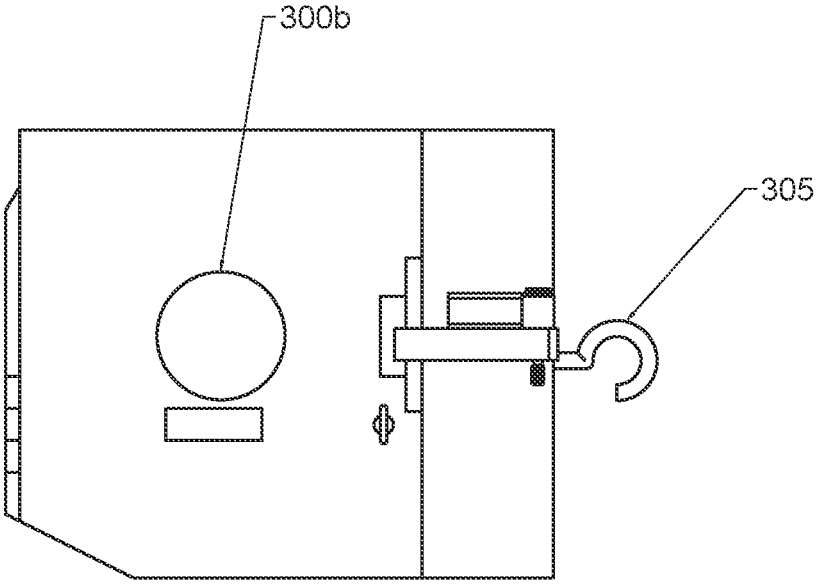
FIG. 8 is a side view of an alternative embodiment of the device to balance application of force, according to example embodiments described and recited herein.

FIG. 7 is a perspective view of an alternative embodiment of the device to balance application of force, according to example embodiments described and recited herein, and FIG. 8 is side view of the alternative embodiment of the device to balance application of force, according to example embodiments described and recited herein.

Device 100 may have handles 300*a* and 300*b* attached to plates 10*a* and 10*b*, respectively, and a load attached at the distal end via hook 305. The user may then pull on the handles, and device 100 may then make any asymmetries in the force application obvious to the user, just as in the application to a rowing machine. This would again force the user to compensate for their asymmetries.

Figure 9:
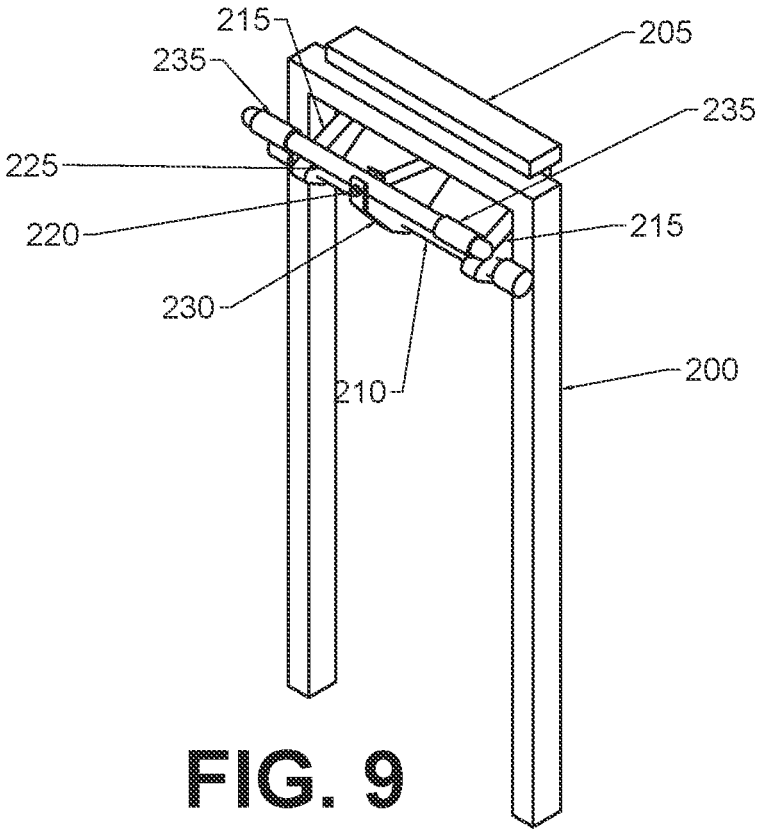
FIG. 9 is a perspective view of an alternative embodiment of the device to balance application of force, according to example embodiments described and recited herein, applied to a pull-up bar.

FIG. 9 is a perspective view of the alternative embodiment of the device to balance application of force, according to example embodiments described and recited herein, applied to a pull-up bar.

Figure 10:
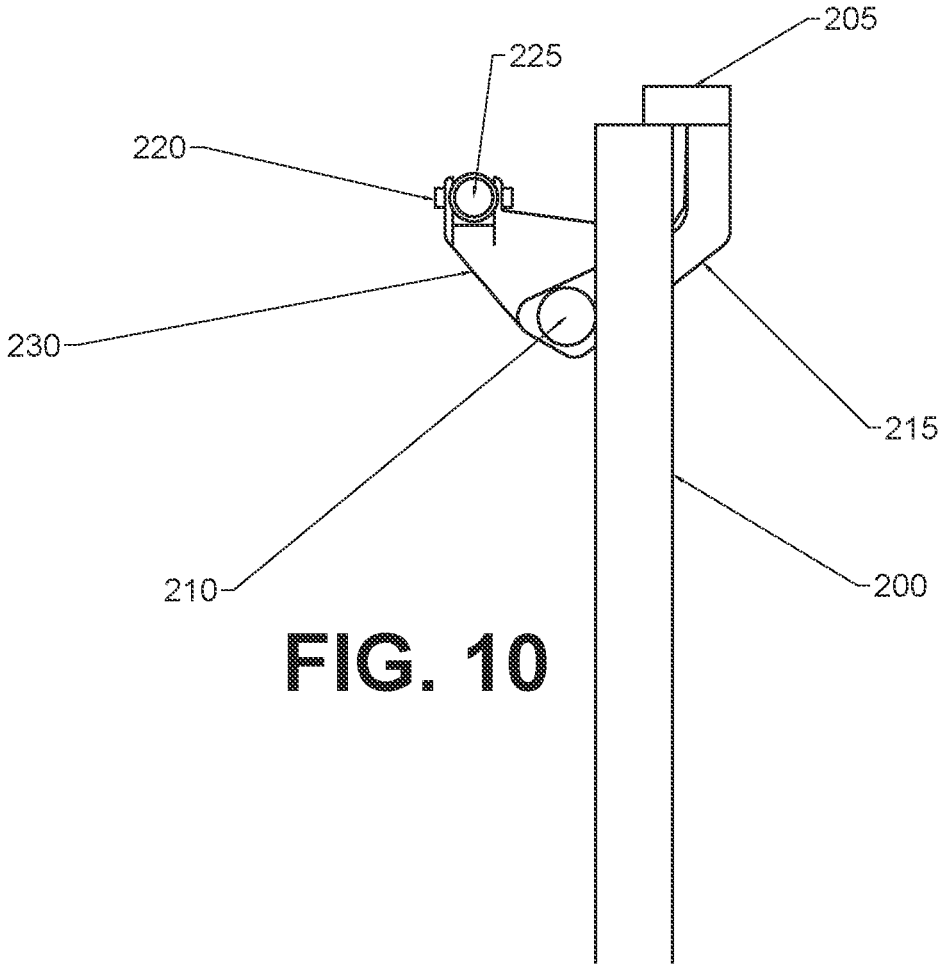
FIG. 10 is a side view of an alternative embodiment of the device to balance application of force, according to example embodiments described and recited herein, applied to a pull-up bar.

FIG. 10 is a side view of an alternative embodiment of the device to balance application of force, according to example embodiments described and recited herein, applied to a pull-up bar.

FIGS. 9 and 10 show the device applied as an improvement to a pull-up bar. Similar to the rowing machine application, the pull-up bar application may force the user to apply force evenly with both hands, balancing asymmetries in the forearms, upper arms, back, and core. For instance, one pull-up bar with the device applied could be used around a door frame 200. A brace 205 may sit above the door frame and then attach to supports 215, which may be connected to another supporting bar 210, which rests against frame 200, providing stability for device 100. Supporting brace 230 may be connected to both bar 210 and brace 205 to provide an attachment place for the main pull-up bar 225, which may be connected to support 230 via pin 220 to enable pull-up bar 225 to pivot. The user may then use the pull-up bar just as any other, grabbing onto the hand grips 235 and pulling themselves up above the bar. However, if force is applied asymmetrically, pull-up bar 225 may pivot vertically on pin 220 and force the user to actively compensate with their muscles. For instance, if the user was right hand dominant, the user might pull harder with their right arm. This would cause the right grip to move closer to the user and the left grip to move away from the user. The user would then be forced to pull harder with their left arm to complete the movement. Over time, the user could develop more symmetrical muscles in the forearms, upper arms, back, and core.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

I claim:

1. An adjunct training device, comprising:

a main frame configured to detachably mount on to a rowing machine having a seat, a left foot pedal, and a right foot pedal;

a fulcrum attached to a backside of the main frame;

a main lever that is centrally and pivotally connected to the fulcrum;

a laterally-disposed left-side actuator, including:

a proximate end configured to receive a user's left-sided force applied by the user sitting on the seat to the left foot pedal, and a distal end attached to a left end of the main lever; and a laterally-disposed right-side actuator, including:

a proximate end configured to receive a user's right-sided force applied by the user sitting on the seat to the right pedal, and a distal end attached to a right end of the main lever, wherein the main lever is configured to pivot on the fulcrum in response to unequal application of the user's left-sided force on the left side actuator and the user's right-sided force on the right side actuator, the pivoting of the main lever longitudinally moving each of the left-side actuator and the right-side actuator relative to the main frame, the longitudinal moving of the left-side actuator and the right-side actuator configured to facilitate an equal application of force from the user on the left side actuator and the right side actuator.

2. The adjunct training device of claim 1, wherein the main frame includes:

a left-side plate having a rail disposed on an exterior side thereof along which the left-side actuator longitudinally glides; and a right-side plate having a rail disposed on an exterior side thereof along which the right-side actuator longitudinally glides, the exterior of the left-side plate and the exterior of the right-side plate facing in opposite directions, wherein the rail of the left-side plate and the rail of the right-side plate are symmetrically aligned and in parallel to each other.

3. The adjunct training device of claim 2, wherein the left-side plate and the right-side plate are disposed between the left-side actuator and the right-side actuator.

4. The adjunct training device of claim 1, wherein the fulcrum is further configured to facilitate an equal application of force from the user's left sided force on the left side actuator and the user's right sided force on the right side actuator by pivoting the main lever to move each of the left side actuator and the right side actuator, the moving of each of the left side actuator and the right side actuator configured to provide leverage to counter-balance the user's left sided force applied to the left side actuator and the user's right sided force applied to the right side actuator.

5. The adjunct training device of claim 1, wherein when mounted to the rowing machine, the pivoting of the main lever is configured to move one of the left-side actuator and the right-side actuator away from the user sitting on the seat and to move the other one of the left-side actuator and the right-side actuator closer to the user sitting on the seat.

6. The adjunct training device of claim 1, wherein the pivoting of the main lever includes moving one of the left pedal and the right pedal in a distal direction and moving the other one of the left pedal and the right pedal in a proximate direction.

7. The adjunct training device of claim 1, further comprising:

damping arms that are configured to:

connect the main lever to the main frame, and provide resistance to the pivoting of the main lever on the fulcrum.

8. The adjunct training device of claim 1, wherein the pivoting of the main lever includes:

longitudinally moving one of the left-side actuator and the right-side actuator in a proximate direction relative to the seat of the rowing machine, and longitudinally moving the other one of the left-side actuator and the right-side actuator in a distal direction relative to the seat of the rowing machine, the distal direction being opposite to the proximate direction.

9. The adjunct training device of claim 1, wherein the pivoting of the main lever includes moving one of the left pedal and the right pedal in a distal direction relative to the seat and moving the other one of the left pedal and the right pedal in a proximate direction relative to the seat.

10. The adjunct training device of claim 1, wherein the fulcrum is further configured to facilitate an adjustment due to an unequal stronger application of force on either of the left side actuator or the right side actuator, respectively, by pivoting the main lever to force the other of the right side actuator or the left side actuator, respectively, towards the user.

* * * * *